US011464694B2

(12) United States Patent
Nikora et al.

(10) Patent No.: US 11,464,694 B2
(45) Date of Patent: Oct. 11, 2022

(54) PATIENT RAISER

(71) Applicants: Anita Nikora, The Basin (AU); Gary Johnson, Cranbourne (AU)

(72) Inventors: Anita Nikora, The Basin (AU); Gary Johnson, Cranbourne (AU)

( * ) Notice: Subject to any disclaimer, the term of this patent is extended or adjusted under 35 U.S.C. 154(b) by 0 days.

(21) Appl. No.: 17/309,060

(22) PCT Filed: Oct. 17, 2019

(86) PCT No.: PCT/AU2019/051130
§ 371 (c)(1),
(2) Date: Apr. 19, 2021

(87) PCT Pub. No.: WO2020/077408
PCT Pub. Date: Apr. 23, 2020

(65) Prior Publication Data

US 2021/0315756 A1 Oct. 14, 2021

(30) Foreign Application Priority Data

Oct. 18, 2018 (AU) ..... 2018903955

(51) Int. Cl.
*A61G 7/053* (2006.01)
*A61G 7/05* (2006.01)
*A61G 7/10* (2006.01)

(52) U.S. Cl.
CPC ..... *A61G 7/053* (2013.01); *A61G 7/1017* (2013.01); *A61G 7/1044* (2013.01);
(Continued)

(58) Field of Classification Search
CPC .... A61G 7/053; A61G 7/1017; A61G 7/1013; A61G 7/1044; A61G 7/1092; A61G 7/1096; A61G 2200/327; A61G 2200/34
(Continued)

(56) References Cited

U.S. PATENT DOCUMENTS 4,887,325 A * 12/1989 Tesch ..... A61G 7/1015 5/84.1
5,327,592 A * 7/1994 Stump ..... A61G 7/1015 254/362

(Continued)

FOREIGN PATENT DOCUMENTS

JP 2002065766 A 12/2002
JP 2005348761 A 12/2005

(Continued)

OTHER PUBLICATIONS

International Search Report and Written Opinion in corresponding International Application No. PCT/AU2019/051130 dated Dec. 20, 2019.

(Continued)

*Primary Examiner* — Robert G Santos
(74) *Attorney, Agent, or Firm* — Westman, Champlin & Koehler, P.A.

(57) ABSTRACT

The application relates to a device for, and method of transferring a patient on a bed between a lying position along a bed to a seated position facing the side of a bed. The device comprises an arm hold to allow the patient to clinch the arm hold to his or her chest, thereby enabling the device to transfer the patient between a lying position and a seated position. Preferably, the device further comprises a leg support to assist in transferring the lower portion of the patients body between a lying position and a seated position.

26 Claims, 10 Drawing Sheets

(52) U.S. Cl.
CPC ..... *A61G 7/1092* (2013.01); *A61G 7/1096* (2013.01); *A61G 2200/327* (2013.01); *A61G 2200/34* (2013.01)

(58) Field of Classification Search
USPC ..... 5/83.1, 87.1, 81.1 R, 662
See application file for complete search history.

(56) References Cited

U.S. PATENT DOCUMENTS

| | | | | |
|---|---|---|---|---|
| 6,039,293 | A | 3/2000 | Minet | |
| 8,336,133 | B2 * | 12/2012 | Palay | A61G 7/1069 5/83.1 |
| 8,549,679 | B2 * | 10/2013 | Tindall | A61G 7/1055 5/83.1 |
| 8,635,720 | B2 * | 1/2014 | Aabakken | A61G 7/1074 5/87.1 |
| 9,131,907 | B2 * | 9/2015 | Moy | A61B 6/0407 |
| 2006/0156469 | A1 | 7/2006 | Ramos et al. | |
| 2007/0295339 | A1 | 12/2007 | Mizuno et al. | |
| 2009/0249544 | A1 * | 10/2009 | Palay | A61G 7/1069 5/83.1 |
| 2011/0238217 | A1 | 9/2011 | Kume et al. | |
| 2011/0302711 | A1 | 12/2011 | Biersteker | |
| 2012/0090090 | A1 * | 4/2012 | Aabakken | A61G 7/1074 5/87.1 |
| 2012/0179289 | A1 * | 7/2012 | Moy | A61G 7/1051 700/213 |
| 2012/0198612 | A1 * | 8/2012 | Tindall | A61G 7/1042 5/83.1 |
| 2014/0000024 | A1 | 1/2014 | Van Loef | |
| 2016/0354267 | A1 | 12/2016 | Masaki | |
| 2021/0315756 | A1 * | 10/2021 | Nikora | A61G 7/053 |

FOREIGN PATENT DOCUMENTS

| | | | |
|---|---|---|---|
| SE | 1100230 | A1 | 3/2011 |
| SE | 534870 | C2 | 1/2012 |

OTHER PUBLICATIONS

Second Written Opinion in corresponding International Application No. PCT/AU2019/051130 dated May 5, 2020.

International Preliminary Report on Patentability in corresponding International Application No. PCT/AU2019/051130 dated Jul. 15, 2020.

* cited by examiner

3(a)

3(b)

3(c)

PATIENT RAISER

CROSS-REFERENCE TO RELATED APPLICATION(S)

This Application is a Section 371 National Stage Application of International No. PCT/AU2019/051130, filed Oct. 17, 2019 and published as WO 2020/077408 A1 on Apr. 23, 2020, in English, and further claims priority to Australian Application Ser. No. 2018903955, filed Oct. 18, 2018.

FIELD

The present invention is generally directed to a device for, and method of, transferring a person on a bed from a lying position to a seated position, and vice versa.

BACKGROUND OF THE INVENTION

Many members of the community are self-sufficient when sitting, standing or walking, but require assistance transitioning from a lying position to a seated position, and vice versa. For example, a woman recovering from Caesarean section surgery may be fully capable of sitting, standing and walking, but may risk rupture of internal sutures should she attempt to lie down, or sit up, without assistance. Others who cannot without assistance lie down, or sit up without risk of pain or serious injury, or due to physical incapacity, may include: those who recovering from bowel surgery, an appendectomy, a hysterectomy, or spinal surgery, the elderly, those suffering from back pain or injury such as resulting from a slipped disc, the morbidly obese, as well as those suffering various illnesses and frailties.

The prior art teaches examples of lifting hoists and the like to assist mobility-impaired patients from entering and exiting a bed. Most of these devices are designed to assist patients who cannot stand or walk, or have difficulty walking without assistance. Such devices are therefore designed to carry the entire weight of a patient in transferring the patient to or from a bed to a wheelchair or similar mobility device, and do not meet the needs of those who can walk without assistance.

Those who require assistance to sit up or lie down are able to sit, stand and walk independently, commonly rely on the assistance of human caregivers to sit up or lie down. In giving such assistance, caregivers can develop problems of their own such as carpal tunnel syndrome, back pain and pinched nerves. Systems to assist such patients to sit up, or lie down, have been previously taught but are not without their problems as now discussed.

US Patent Application 2014/000024 A1 discloses a method for moving a patient from a lying position to a sitting position on the end of a bed by means of an appliance. The appliance includes a support element as well as a first section that is formed by a cross bar and a connecting element. In use, a support person is required to raise the knees of the patient and insert the first section of the appliance behind the raised knees of the patient while also connecting the first section of the device to the upper body of the patient. The support person then pushes down on the appliance to raise the patient to a seated position. While the appliance reduces the physical strain on a support person to raise the patient to a sitting position, it nevertheless requires a support person, which may not always be available and may add to the overall expense of caring for the patient.

US Patent Application 2006/0156469 A1 discloses a 'Bed Patient Raise-Sit' system for raising or lowering the upper section of the body of a patient, and for turning the patient to a sitting position on the side of the bed and back to the lying position. The device resembles a stretcher or cot comprising three folding members which correspond to the lower (i.e. below knees), middle (i.e. between knees and torso) and upper (i.e. torso and head) sections of the human body. The upper and lower sections may be raised or lowered either manually, or via a mechanised actuator. To operate the device and enable a patient to sit up, the patient is strapped on to the device and the upper and lower sections are folded to place the patient in a sitting position. The disclosed device provides a number of disadvantages, including requiring a patient to be positioned on and strapped to the device before use (therefore necessitating use of a caregiver). In addition, the device does not appear to be designed to enable a patient to transfer to and from a pre-existing bed. Rather, it appears that the device takes the place of a bed, reducing comfort for the patient and the flexibility of the device.

U.S. Pat. No. 6,039,293 A discloses an auxiliary device to aid a bed-ridden or disabled patient to sit up and leave a bed. The device includes a holder and an arrangement for securing the holder to the side of the bed. The holder itself comprises a height adjustable post extending upward from the bed with grips for the patient. In use, the patient grips the holder to pull themselves into an upright position. While the device would assist certain patients to sit up or lie down, the device nevertheless requires a certain level of dexterity and strength on the part of the patient, and risks injury to patients suffering certain ailments. The device would therefore not be suitable to assist all patients, particularly those suffering more severe ailments.

Despite the earlier attempts of others, it remains desirable to provide a device and method for enabling a patient, who is capable of standing and walking independently, to sit up or lie down which:

(a) does not require strenuous effort or strength from the patient;
(b) reduces risk of pain or injury to the patient; and
(c) does not require the assistance of a human caregiver.

The reference in this specification to any prior publication, or information derived from it, or to any earlier study or other matter, is not, and should not be taken as an acknowledgement or admission or any form of suggestion that the prior publication, or information derived from it, or other matter forms part of the common general knowledge in the field of endeavour to which this specification relates.

SUMMARY

The inventors have discovered a device and method enabling a person to sit up or lie down in bed while reducing risk of pain and injury.

According to a first aspect, there is provided a device to assist a patient on a bed to transfer between a lying position and a seated position, the device comprising an arm hold configured to allow the patient to clinch the arm hold to his or her chest and, when so held, transfer the patient between a lying position and a seated position.

Preferably, the arm hold comprises a panel configured to be clinched by the patient between the forearm and the chest of the patient, and a hand grip configured to be gripped in the hands of the patient.

Preferably, the device is configured to enable the position and/or motion of the arm hold to be customised for use with beds and patients of varying dimensions.

Preferably the arm hold is configured to retract, and thereby provide clearance and sufficient space to enable the patient and others to move around the bed, when not in use.

Preferably, the device further comprises a leg support configured to transfer the legs of the patient between a lying position and a seated position.

Preferably, the leg support comprises a panel incorporating recesses configured to generally conform to the legs of the patient.

Preferably, the leg support is configured to rotate the lower legs of the patient about a horizontal axis between a lying position, in which the lower legs are substantially horizontal, and a seated position, in which the lower legs are substantially vertical.

Preferably, the device is configured to allow the position and/or motion of the leg support to be customisable for use with beds and patients of varying dimensions.

Preferably, the leg support is configured to retract, and thereby provide clearance sufficient space to enable the patient and others to move around the bed, when not in use.

Preferably, the leg support is configured to slide between the lower legs of the patient and the bed to position the leg support when activated for use to transfer the patient from a lying position to a seated position.

Preferably, the arm hold and the leg support are configured to pivot the patient about his or her buttocks such that the patient will, when in a seated position, face a side of the bed.

Preferably, the device is configured to be adjustable to allow for selection of which side of the bed the patient will face when in the seated position.

Preferably, the device is configured to be controlled by the patient, thereby allowing the patient to transfer between a lying position and a seated position without assistance from a human caregiver.

Preferably, the device is configured to transfer the patient between a lying position and a seated position in less than two seconds.

Preferably, the device comprises a back up power source to operate the device in case of an electricity outage.

Preferably, the device comprises a stabilizer which extends under or around a bed to stabilize the device against toppling over when transferring a patient between a lying position and a seated position.

Preferably, the device comprises a pull up hold that a patient may hold to stabilize him or herself when transferring between a seated position and a standing position.

According to a second aspect of the invention, there is provided a method of using the device wherein a patient clinches the arm hold to his or her chest and is transferred between a lying position and a seated position.

Preferably, the position and/or motion of the arm hold may be customised, and the method comprises customising the position and/or motion of the arm hold to suit the dimensions of the bed and the patient.

Preferably, the arm hold is retractable, and the method comprises retracting the arm hold retracts when not in use to enable the patient to move around the bed.

Preferably, the device comprises a leg support, and the leg support transfers the legs of the patient between a lying position and a seated position.

Preferably, the position and/or motion of the leg support may be customised, and the position and/or motion of the leg support is calibrated to suit the physical dimensions of the bed and the patient.

Preferably, the leg support is retractable, and the method comprises retracting the leg support when not in use to enable the patient to move around the bed.

Preferably, the leg support is configured to slide between the lower legs of the patient and, and the leg support slides when between the bed and the lower legs of the patent to position the leg support when preparing to transfer the patient from a lying position to a seated position.

Preferably, transfer of the patient between a lying position and a seated position takes less than two seconds.

Preferably, the device may be controlled by the patient, and the patient activates the device to transfer between a lying position and a seated position.

The present summary is provided only by way of example, and not limitation. Other aspects of the present invention will be appreciated in view of the entirety of the present disclosure, including the entire text, claims and accompanying figures.

Throughout this specification and the claims which follow, unless the context requires otherwise, the word "comprise" and variations thereof such as "comprises" and "comprising", will be understood to include the inclusion of a stated integer or step or group of integers or steps but not the exclusion of any other integer or step or groups of integers or steps.

Figure 1:
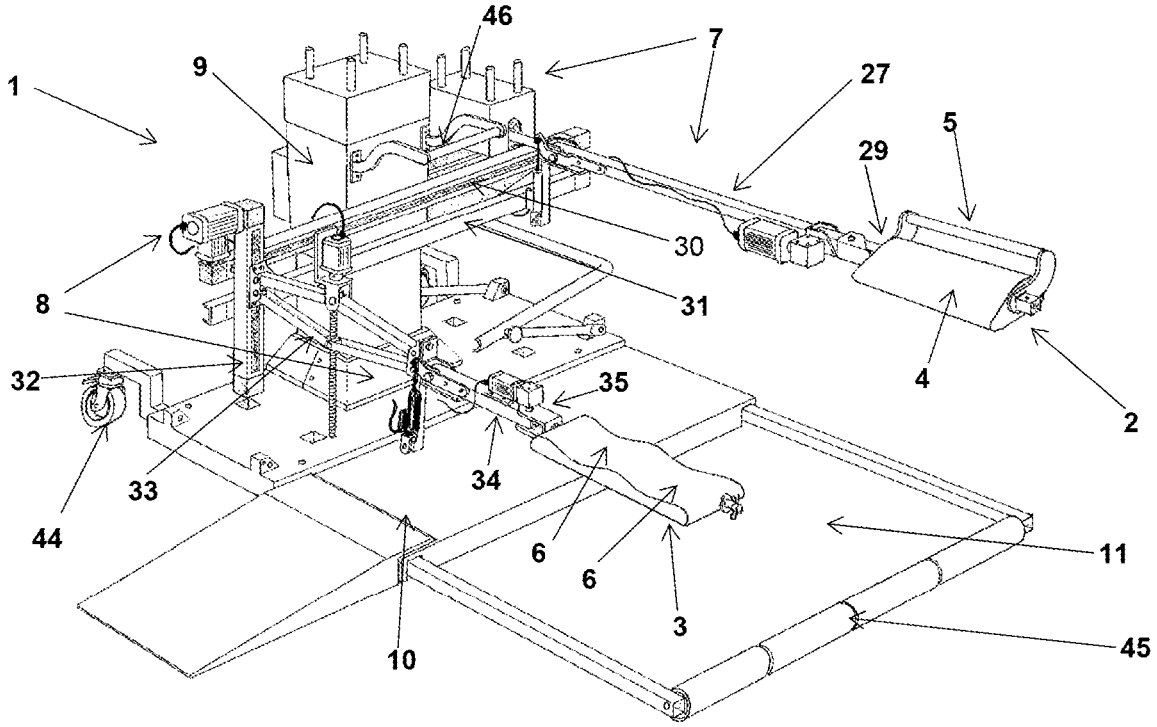
FIG. 1 shows a patient raiser device according to an embodiment of the invention.

While the above-identified figures set forth one or more embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

The invention is now further described as exemplified in the FIGURES.

Figure 2:
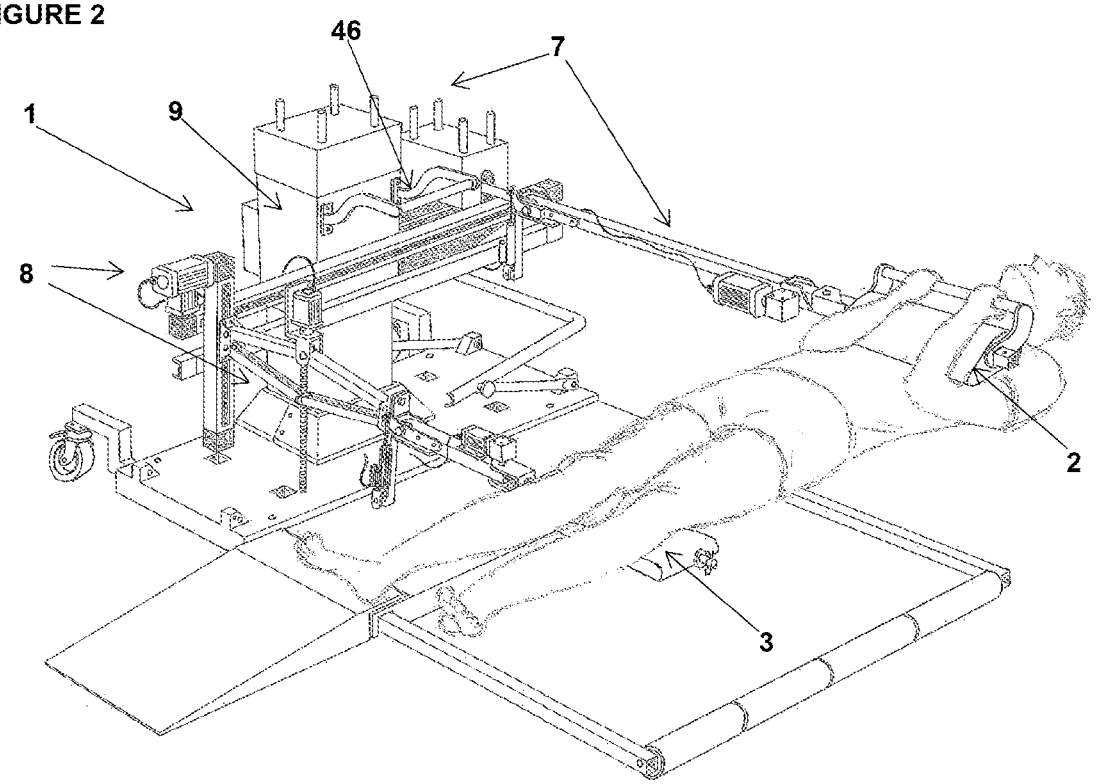
FIG. 2 shows a device according to FIG. 1 demonstrating the position of a lying patient with respect to the device.

FIGS. 1 and 2 show a patient raiser device 1 comprising an arm hold 2 and a leg support 3. The arm hold further comprises a 'cuddle pad' 4, and a hand grip 5. In use a patient clinches the arm hold 2 to his or her chest has shown in FIG. 2. The leg support 3 comprises a panel incorporating recesses 6 to accommodate each leg of the patient as shown in FIG. 2.

In the embodiment shown the device comprises a leg support 3, which is an optional feature of the invention that may not be required where a person has sufficient strength to rotate on his or her buttocks to face a face of the bed once sitting up, or to face the end of the bed in preparation for lying down.

The arm hold 2 and the leg support 3 each connect to a centre post assembly 9 via an arm hold assembly 7 and a leg support assembly 8 respectively. To stabilise the device 1 against the weight of the patient, and prevent the device 1 from tipping over in use, the centre post assembly 9 may be connected to a walk off platform 10 and under bed stabilizer 11.

The movement of the arm hold 2 and leg support 3 during transfer of a patient is now described with reference to FIG. 3 and FIG. 4. It should be noted that reference to transfer between a lying position and a seated position takes account of either having the patient sit up or having the patient lie down.

Figure 3:
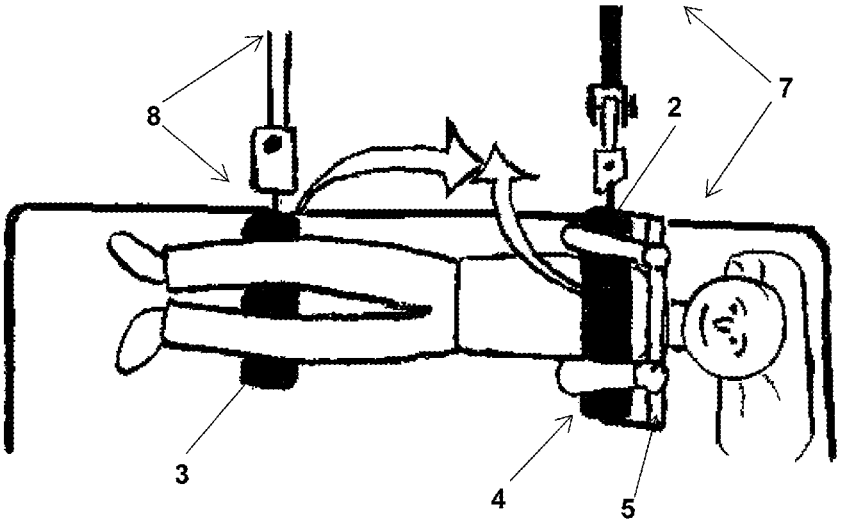
FIG. 3 shows a plan view of a sequence of stages from a lying position to a sitting position using a patient raiser device according to an embodiment of the invention.
Figure 3:
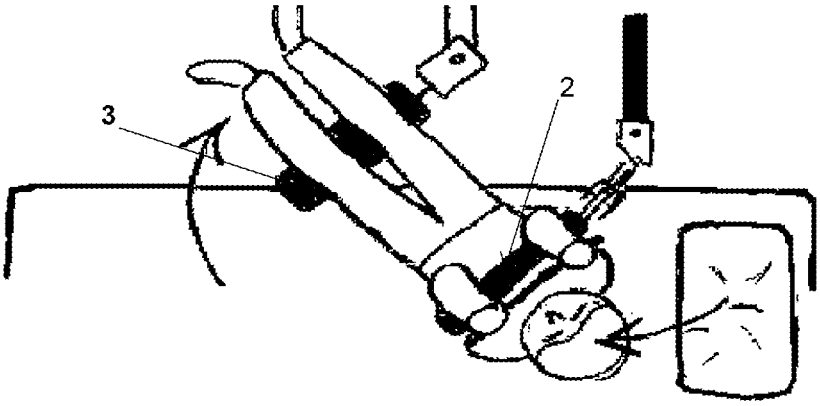
Figure 3:
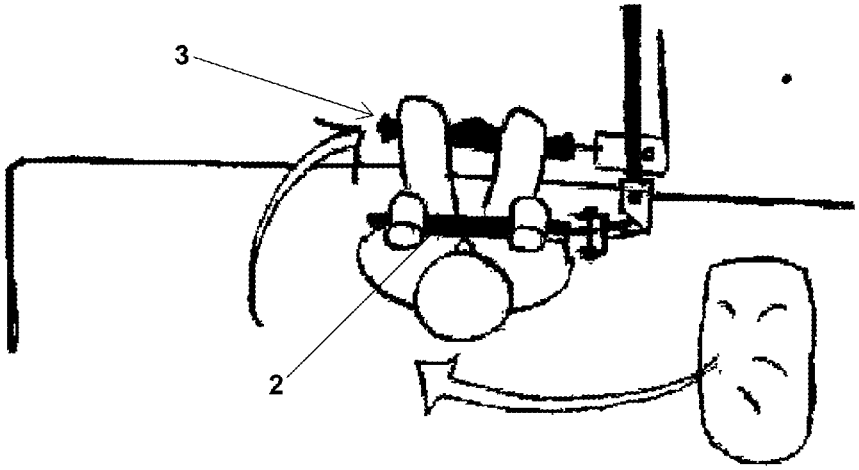
Figure 4:
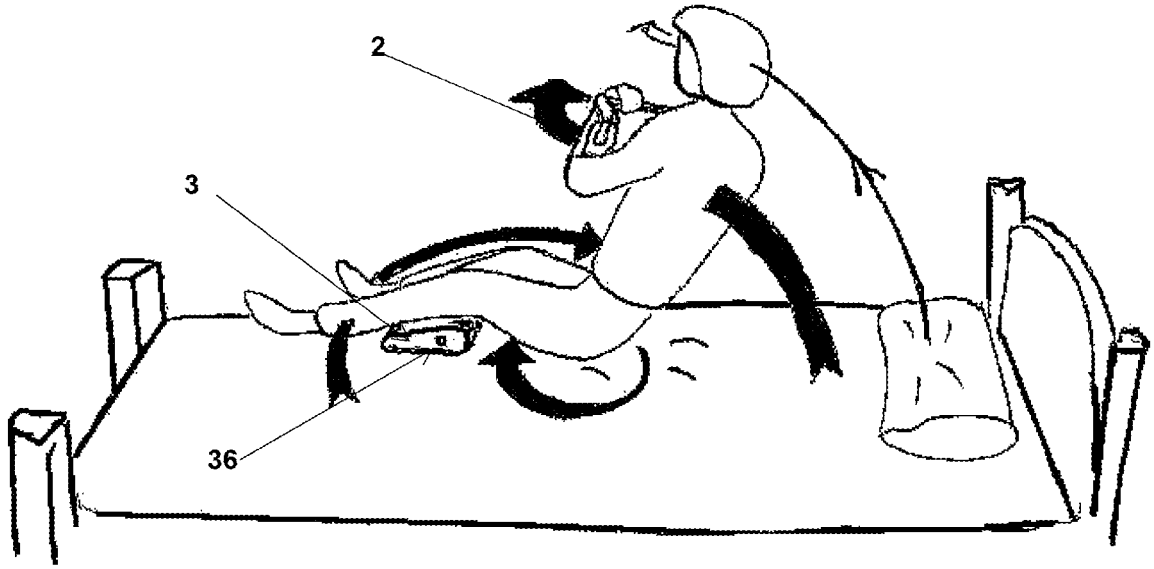
FIG. 4 shows a patient part-way through being raised by a patient raiser device according to an embodiment of the invention.

FIG. 3(*a*) shows the patient in a lying position preparing for transfer to a seated position. As shown, the patient clinches the arm hold 2 comprising cuddle pad 4 and hand grip 5, to his or her chest, while the leg support 3 is positioned under the lower legs of the patient, just below the knee of the patient. FIG. 3(*b*) and FIG. 4 show the patient approximately mid-way transfer to a seated position. As shown in FIG. 3(*b*), the arm hold 2 and leg support 3 operate together to pivot the patient on his or her buttocks from a lying position along the bed to a seated position facing a side of the bed. Simultaneously, as shown in FIG. 4, the arm hold 2 raises the torso of the patient from a lying position to a seated position.

FIG. 3(*c*) shows the patient in a seated position facing a side of the bed. As shown in FIG. 3(*c*), the leg support 3 also rotates the lower legs to align vertically. The arm hold 2 is also raised from its position (not shown), by rotating in a boom gate style from droop joint 28 (see FIG. 5) to allow the patient to stand and exit the bed.

The device 1 is pre-programmed to perform the above process by software/firmware programming controlling movement and positioning of the arm hold 2 and leg support 3. To minimise strain on the back and abdomen of the patient, the device 1 may be programmed to transfer the patient between a lying position and a seated position in less than two seconds. Programming may also provide for automated retraction of the arm hold 2 and leg support 3 when not in use to provide space around the bed. When required for use the device 1 will position the arm hold 2 and leg support 3 based on whether the patient seeks to sit up or lie down.

The device 1 may comprise a control to enable the patient to control the device 1 for him or herself. The control may be separate to the device, and may for example involve a smartphone or tablet application connecting to the device 1 via Bluetooth. When providing such control, the device 1 may be programmed with a timer allowing the patient time to prepare him or herself after requesting transfer between positions. The device 1 may include a countdown to prevent surprising the patient during the transfer movement. Alternatively, the device 1 may additionally comprise a safety button or similar on the arm hold 2, which may be pressed by the patient to indicate he or she is prepared for transfer between positions, or no longer seeks to transfer between positions (and instead seeks retraction of the arm hold 2 and leg support 3).

While the device 1 is generally exemplified transferring a patient from a lying position to a seated position, it is noted that the device 1 is equally capable of assisting a patient from a seated position to a lying position, which may be equally painful or dangerous to a patient. To do so the device 1 merely reverses the movements necessary to raise a patient from lying down to sitting up. This process may also be controlled by a patient using existing controls for the device. Again, the process may be controlled to take less than two seconds (for example, 1.5 seconds) to avoid unnecessary strain to the abdomen and spine of the patient. This speed could be adjusted by the patient to ensure patient comfort.

The device 1 may further comprise a pull up hold 46 that could for example extend from or form part of the centre post assembly 9. In use the pull up hold 46 would be within reach of a patient sitting on the side of a bed and could be held by a patient to stabilize him or herself while he or she stood up from the bed.

Figure 5:
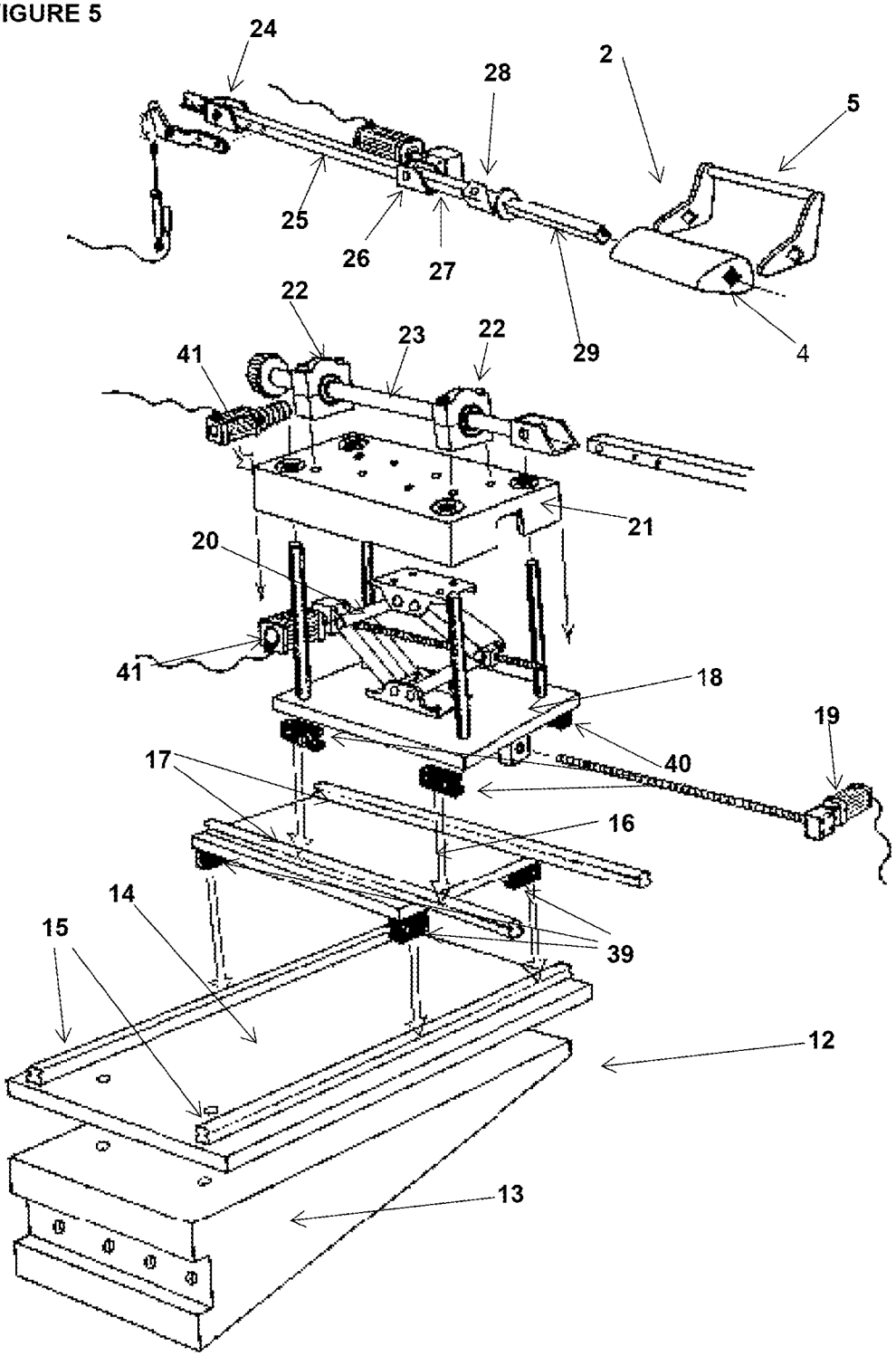
FIG. 5 shows an exploded view of a torso lift assembly according to an embodiment of the invention.
Figure 6:
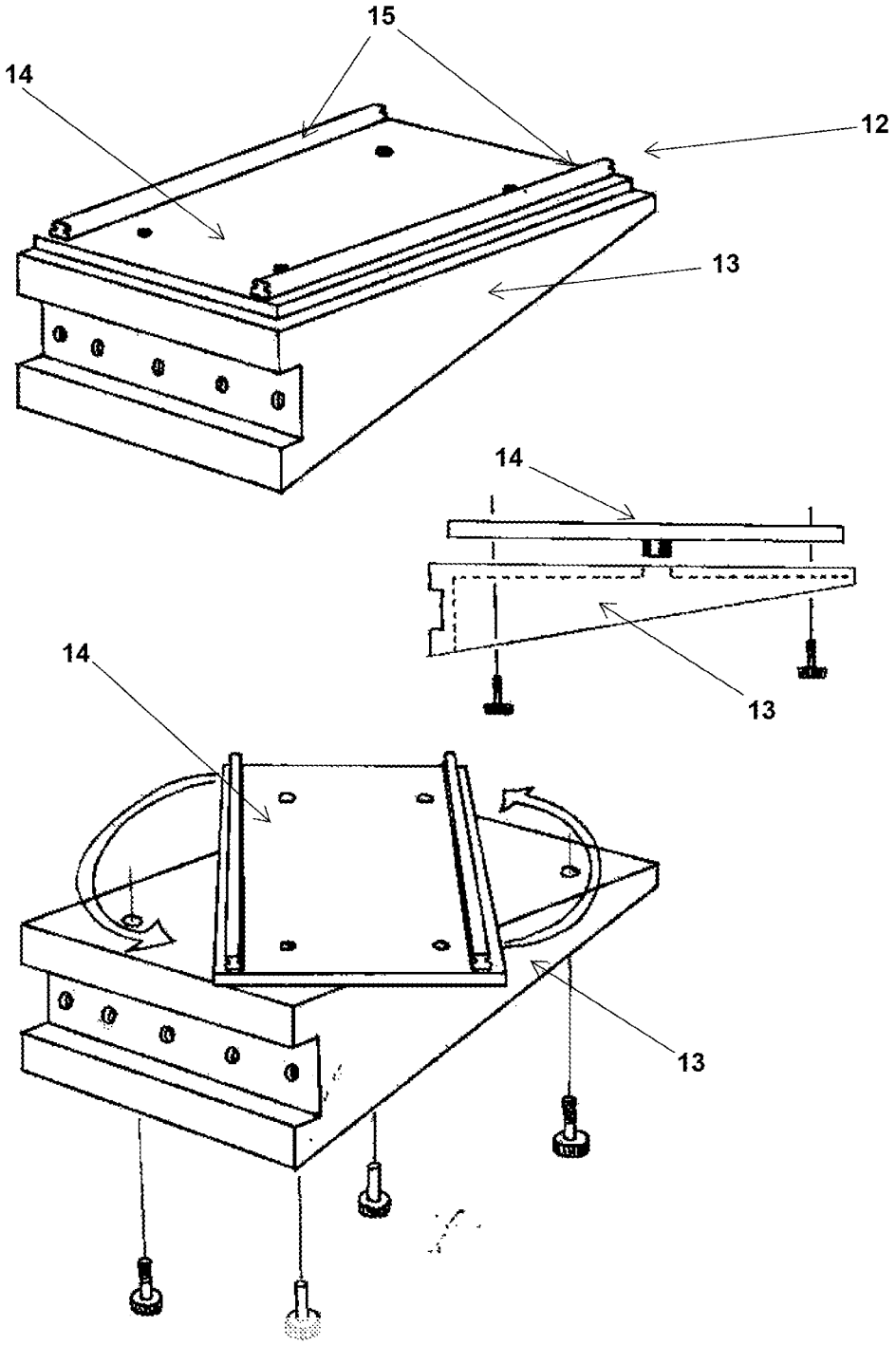
FIG. 6 shows a torso lift assembly mounting shelf according to an embodiment of the invention.

Construction of the arm hold assembly 7 is now described with reference to FIG. 5. The arm hold 2 is mounted to the central post assembly 9 via a mounting shelf 12. The mounting shelf 12 comprises a mounting support 13 and a turn plate 14. Operation of the turn plate 14 will be further described with reference to FIG. 6. The turn plate 14 comprises slide tracks 15 enabling lower slide plate 16 to slide along the turn plate 14 via roller blocks 39. Motion of the lower slide plate 16 along the turn plate 14 may be controlled by a drive mechanism (not shown). The lower slide plate 16 also includes slide tracks 17 enabling upper slide plate 18 to slide along the lower slide plate 16 via roller blocks 40. Motion of the upper slide plate 18 along the lower slide plate 16 may be controlled by a drive mechanism 19, shown as a motor driven threaded rod. The combined effect of the lower slide plate 16 and the upper slide plate 18 provides linear motion in two dimensions. To enable linear motion in third dimension, a raising jack 20, actuated by a motor driven threaded rod 41, is mounted atop the upper slide plate 18 to raise and lower torso lift plate 21. Atop the raising support 21 is mounted block bearings 22, which house roll shaft 23. The roll shaft 23, actuated by drive mechanism 41, is connected via an elbow 24 to a first roll shaft extension tube 25, which is in turn connected via actuated elbow 26 to a second roll shaft extension tube 27. The second roll shaft extension tube 27 is further connected via another droop joint 28 to cuddle pad tube 29, which supports the arm hold 2. Rotation of the roll shaft 23 enables the arm hold 2 to roll as necessary to complete the movement shown in FIGS. 3(*a*) to 3(*c*) and FIG. 4. The arm hold assembly 7 provides motion in all directions necessary to provide the motion of the arm hold 2 shown in FIGS. 3(*a*) to 3(*c*) and FIG. 4, and such motion may be customised to meet the dimensions of particular patients and beds.

As shown in FIG. 1 and FIG. 2, the arm hold assembly 7 is mounted to the right hand side of the central post assembly 9. However, to enable the patient raiser device 1 to be used in respect of either side of a bed, the arm hold assembly 7 may be alternatively mounted to the left hand side of the central post assembly 9. This is enabled via the turn plate 14 as further detailed in FIG. 6, which enables rotation on top of mounting shelf 12 against the remainder of the arm hold assembly 7. Once the arm hold assembly 7 is mounted to the other side of the central post assembly, and the turn plate 14 is appropriately rotated, the arm hold 2 can be rotated on cuddle pad tube 29 to realign the arm hold assembly 7. From there, it is a matter of re-setting the controls to allow for use on the opposite side of the bed. The leg support assembly 8, as now described in further detail, would not require structural modification to operate on either side of the bed, other than reversing position of the leg support 3 on the leg support rod 36 by removing the leg support 3 and re-installing in a reversed position on the leg support rod 36 (since the leg support 3 is installed in an offset position on the leg support rod 36—as best shown in FIG. 4).

Figure 13:
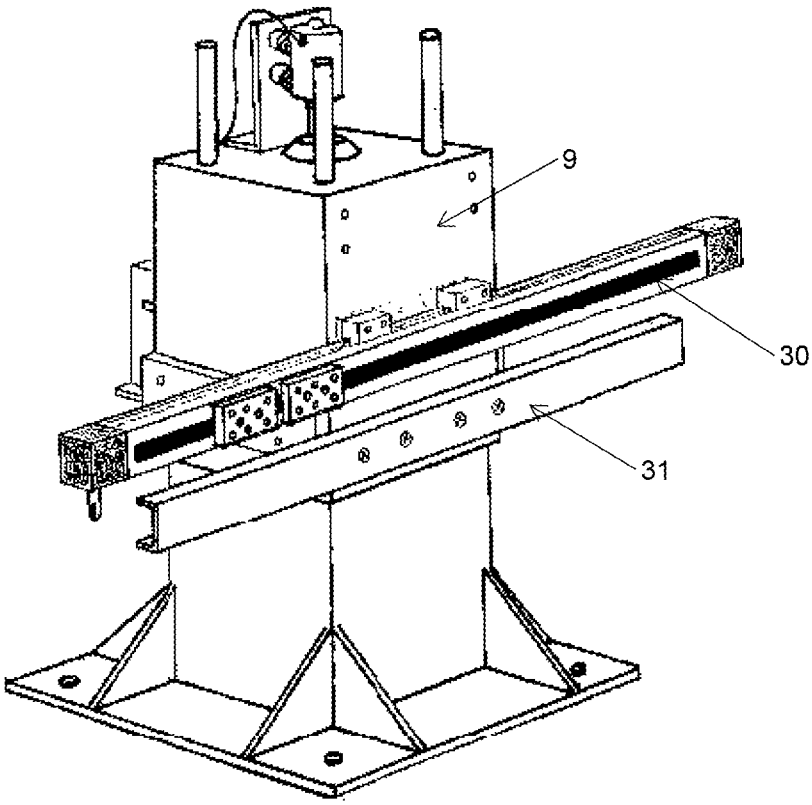
FIG. 13 shows a centre post assembly with mounted linear slide carriage according to an embodiment of the invention.

Construction of the leg support assembly 8 is now described with respect to FIGS. 1 and 2, and FIG. 13. FIG. 13 shows central post assembly 9 with a linear slide carriage 30 and linear slide carriage support track 31 mounted thereto. The linear slide carriage 30 enables horizontal movement of the leg support assembly 8 across the face of the central post assembly 9. A vertical slide mount 32 is attached to linear slide carriage 30 to enable vertical movement of the leg support assembly 3. To enable movement to and from the side of the bed, a scissor jack 33 is then mounted to the vertical slide mount 32, thus enabling movement of the leg support assembly 8 in three dimensions. A shaft 34 is mounted to the scissor jack 33 which is in turn connected via a knuckle joint 35 to a leg support rod 36. The leg support rod 36 holds the leg support 3 in place. As shown in FIGS. 1 and 2, movement of the leg support assembly 8 is actuated by motors and threaded rods, etc., however means of actuation as known to the person skilled in the art can be utilised, including hydraulics.

Figure 7:
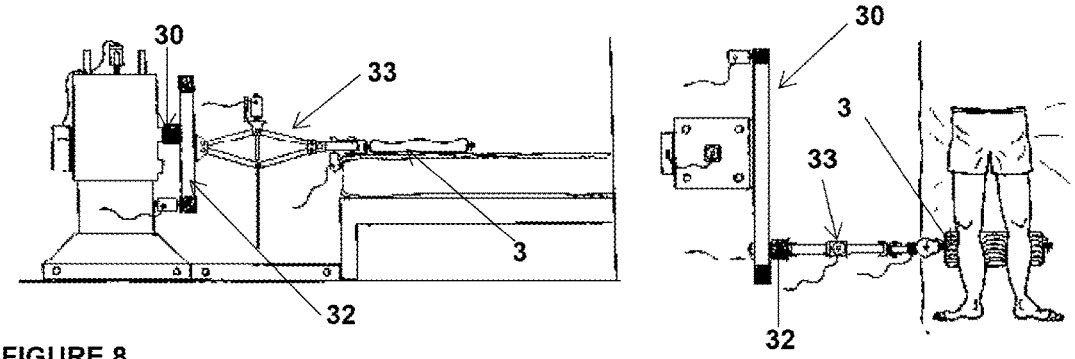
FIGS. 7 to 11 show a leg support assembly from a side view and a plan view though various stages of transferring between a patient from a lying position and a seated position according to an embodiment of the invention.
Figure 8:
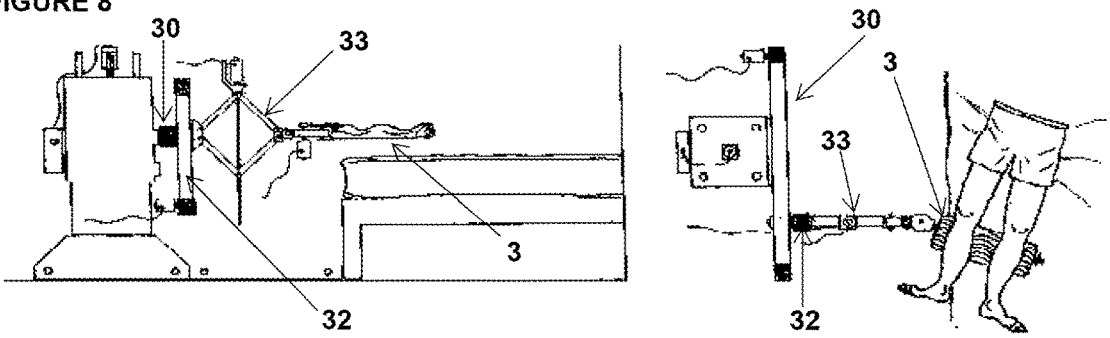
Figure 9:
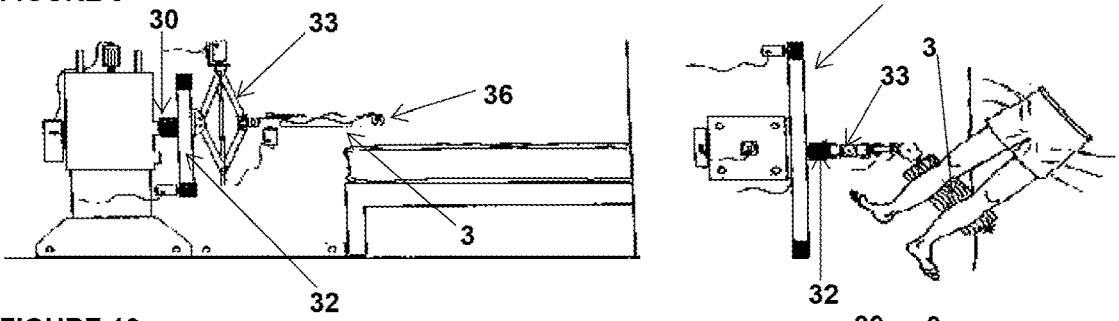
Figure 10:
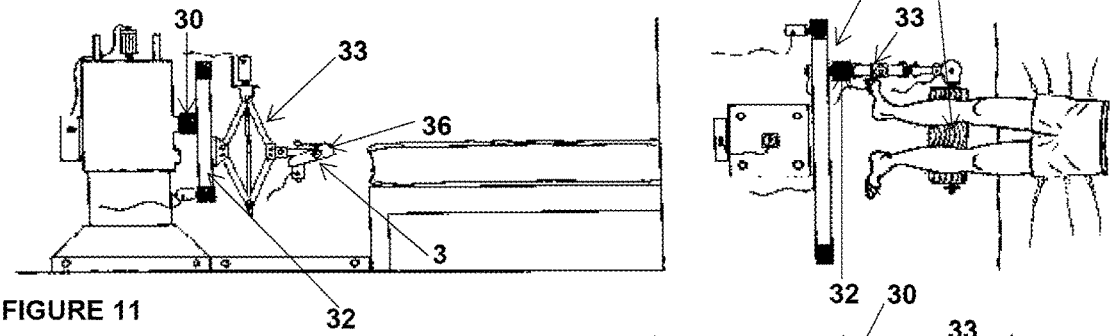
Figure 11:
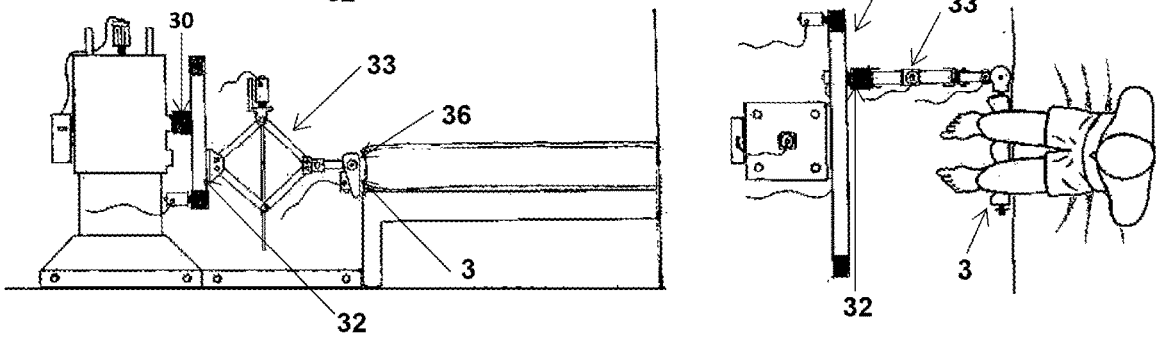

Motion of the leg support 3 and leg support assembly 8 is now described with reference to FIGS. 7 to 11. FIGS. 7 to 11 show the stage-wise motion of the leg support assembly 8 as a patient is transferred from a lying position to a seated position. As shown in FIG. 7, the patient is in a lying position with the leg support 3 positioned underneath the lower legs just below the knees. As shown in FIG. 7, scissor jack 33 is extended to enable the leg support 3 to overlie the bed, while the linear slide carriage 30 and vertical slide mount 32 allow for appropriate positioning. Moving through FIGS. 8 to 10, the legs of the patient are raised and rotated about the torso of the patient by the leg support 3 to face a side of the bed. As shown by FIGS. 8 to 10, this involves three dimensional movement of the leg support assembly 8 such that the vertical slide mount 32 moves along the linear slide carriage 30, the scissor jack 33 moves along the vertical slide mount 32, the scissor jack 33 retracts, and the leg support 3 rotates about shaft 34. Turning to FIG. 11, the leg support 3 is finally brought alongside the side of the bed to lower the lower legs of the patient and allow the patient to stand up.

Figure 12:
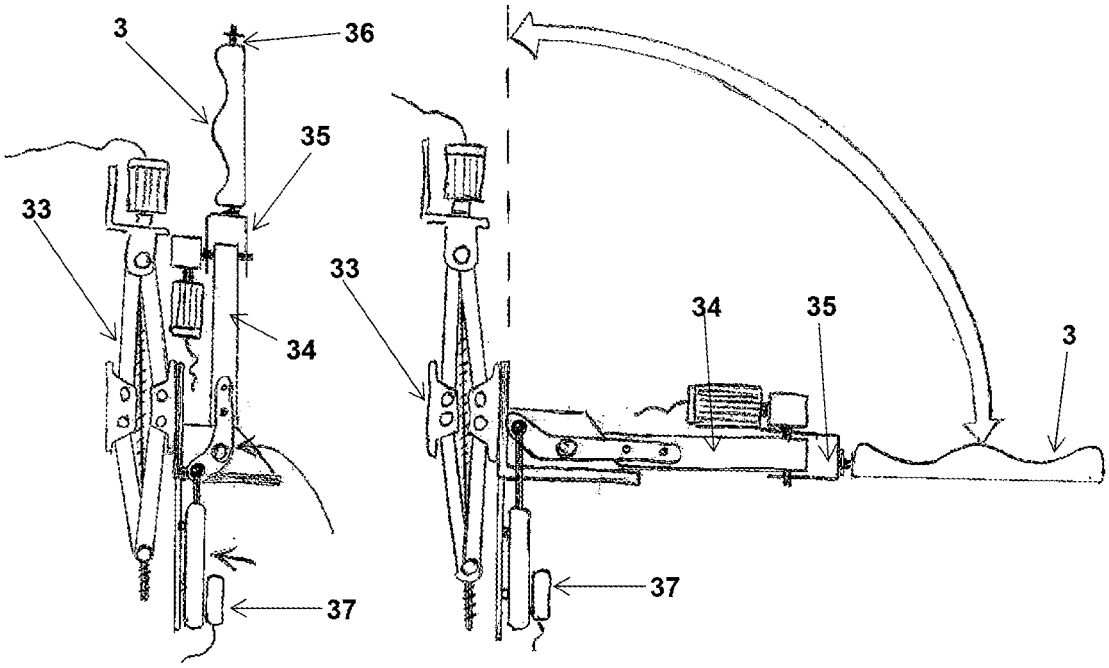
FIG. 12 shows a leg support assembly in an in use position and a retracted position according to an embodiment of the invention.

As highlighted by FIG. 12, the leg support assembly 8 enables retraction of the leg support 3 via upward rotation of the shaft 34 from the scissor jack 33. Movement of the shaft 34 is actuated by telescopic cylinder 37.

Figure 14:
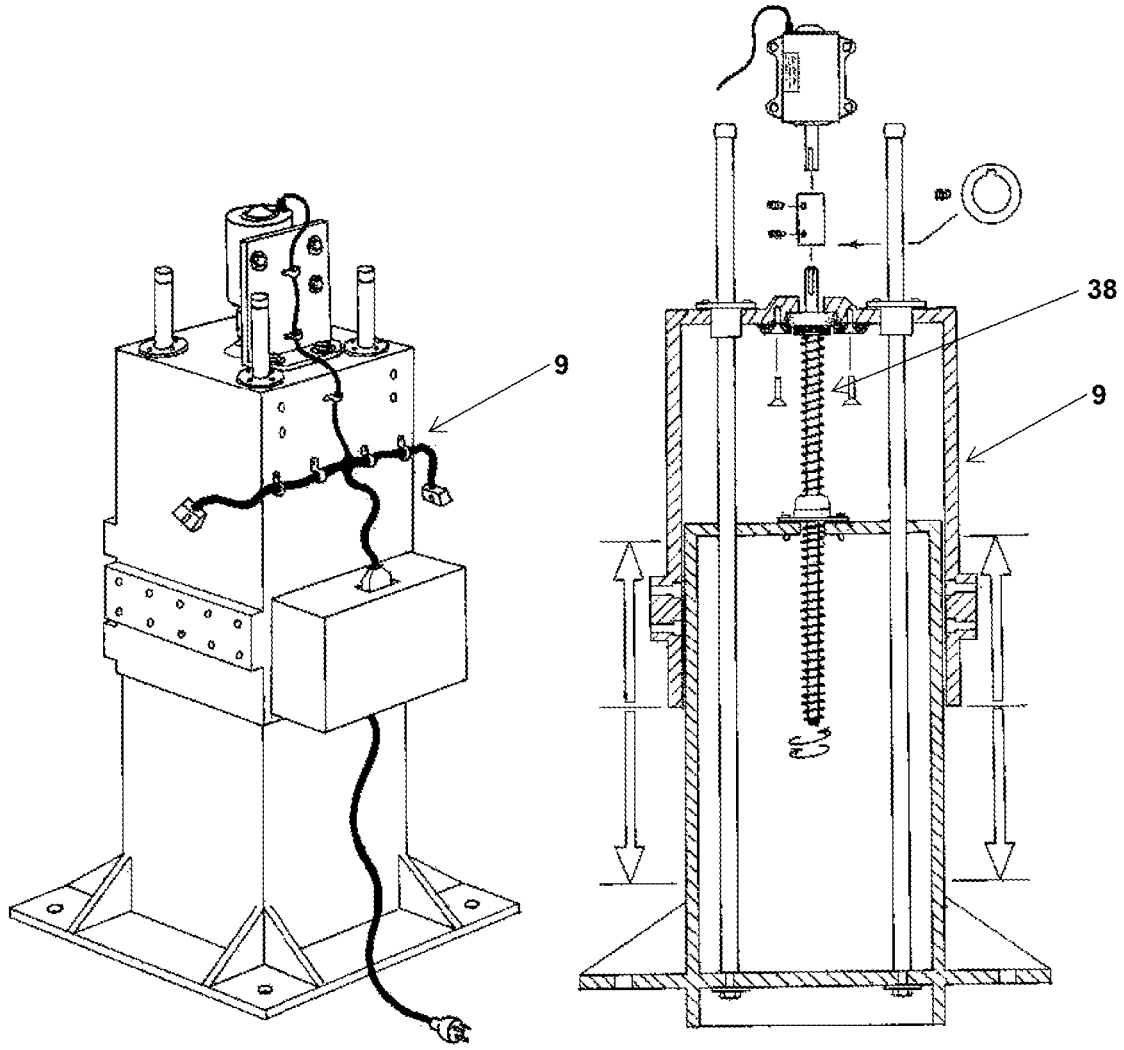
FIG. 14 shows the reverse side of a centre post assembly according to an embodiment of the invention.

The height of the central post assembly 9 may also be adjusted, thereby further adding flexibility to the device. As shown in FIG. 14, the height may be adjusted by a leadscrew mechanism 38. Alternatively, the height may, for example, be adjusted hydraulically or pneumatically via a telescopic cylinder.

The device 1 may be powered by standard household electricity (for example, in Australia, 240V). Preferably, the device is fitted with a back up power source, to enable a patient to transfer to and from bed in a power outage. The back up power source may be a battery, fuel cell or similar. The back up power source be configured to automatically provide power in case of a power outage, or a person may switch to the back up power source manually, as and when required.

Figure 15:
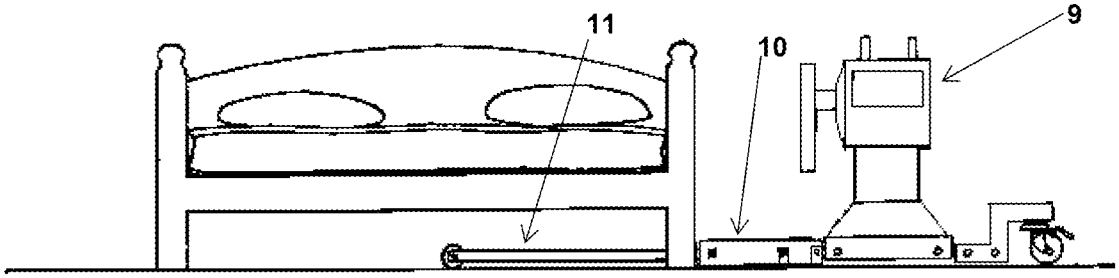
FIG. 15 shows a device according to an embodiment of the invention next to a bed, in which a floor stabiliser extends underneath the bed.
Figure 16:
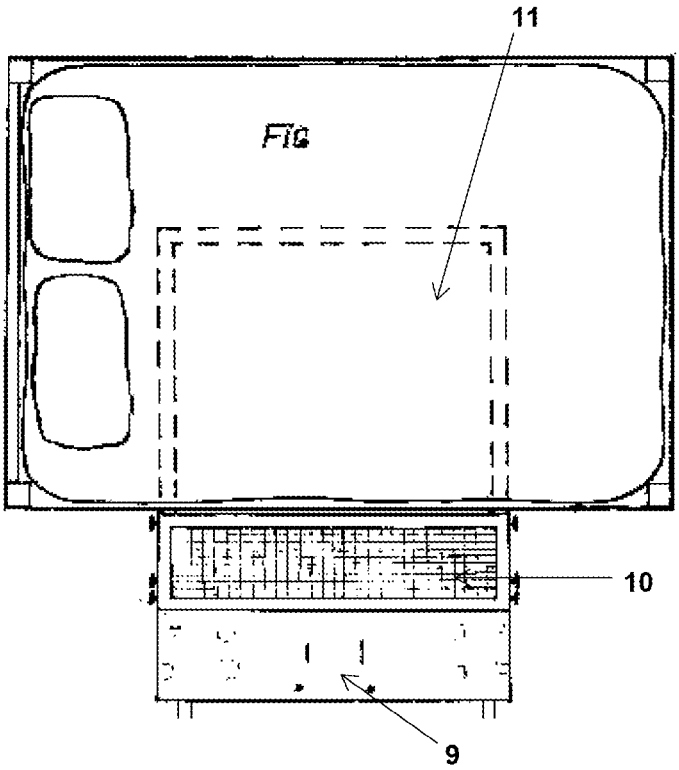
FIG. 16 also shows a device according to an embodiment of the invention next to a bed, in which a under bed stabiliser extends underneath the bed.
Figure 17:
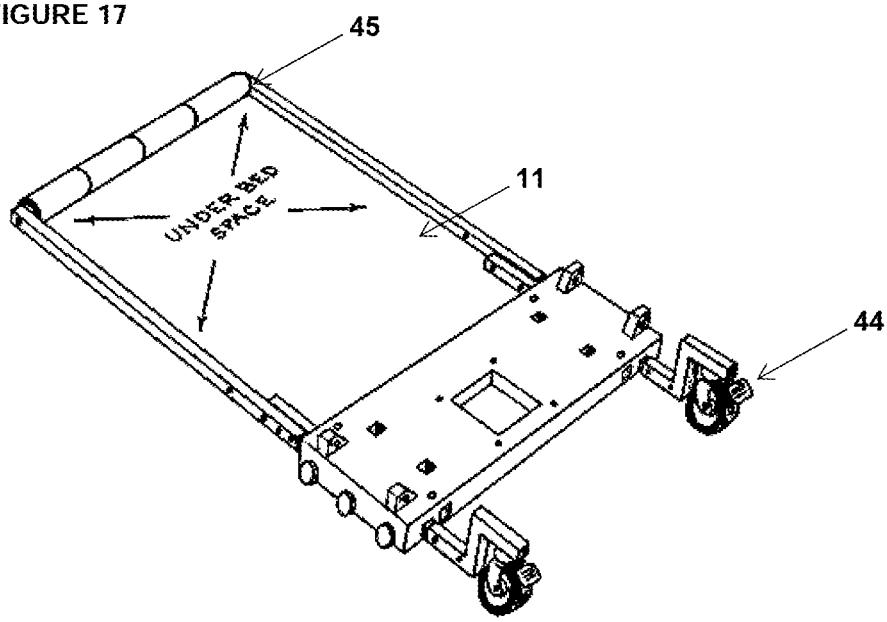
FIG. 17 shows an under bed stabilizer according to an embodiment of the invention.
Figure 18:
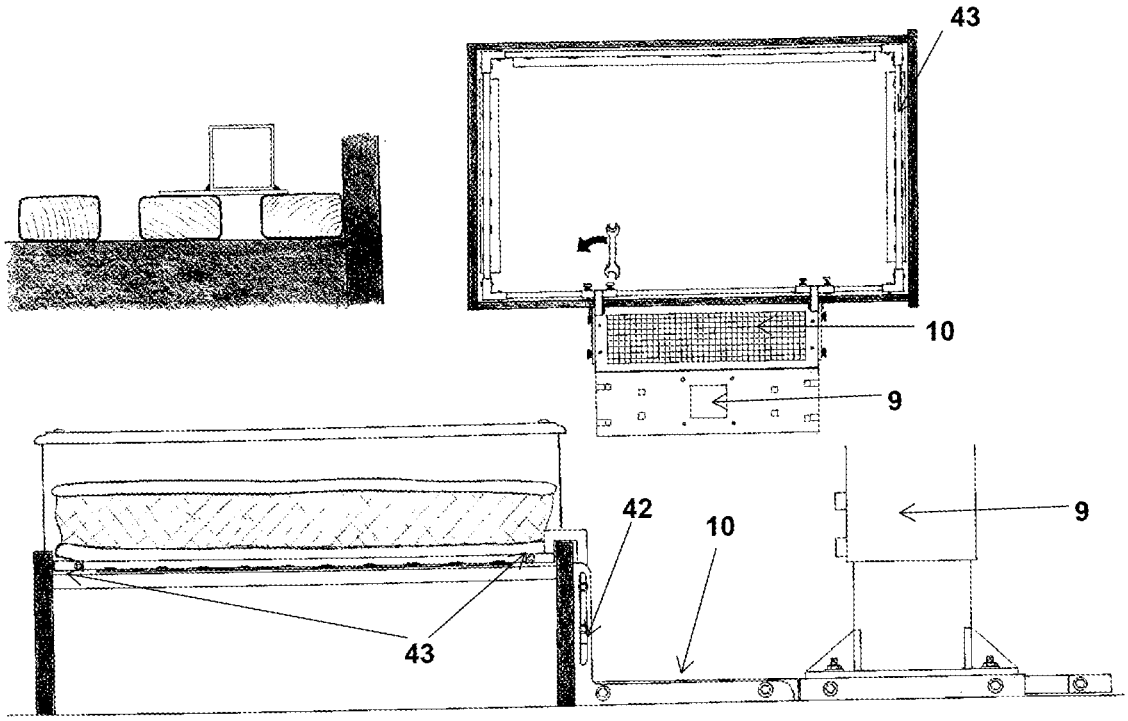
FIGS. 18 and 19 show a solid base bed stabilizer according to an embodiment of the invention.
Figure 19:
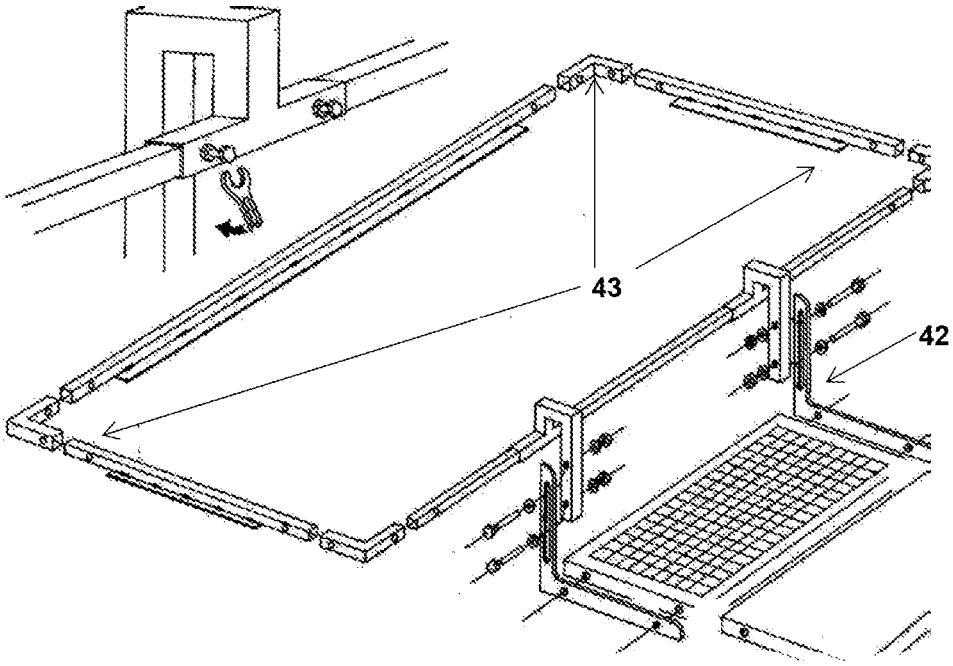

FIG. 15 shows the device 1 stabilised by the walk off platform 10 and under bed stabilizer 11 (as further detailed in FIGS. 16 and 17). To transfer a patient between a lying position and a seated position, the device 1 is required to take on some of the weight of the patient through the arm support 2. This may leave the device 1 in an unbalanced and liable to topple over. To avoid having the device 1 topple over, a walk off platform 10 and under bed stabilizer 11 may be connected to the central post assembly 9. The under bed stabilizer 11 may comprise wheels 44 and rollers 45 as shown in FIG. 17.

Where the bed goes all the way to the ground, and thereby prevents use of an under bed stabilizer 11, the device 1 may be braced over and around the bed, using for example a hockey stick brace mechanism 42 as shown in FIG. 18 and FIG. 19. FIG. 19 shows a solid base bed stabilizer frame 43 for use with a bed having a solid base.

It will be understood to persons skilled in the art of the invention that modifications may be made without departing from the spirit and scope of the invention. The embodiments and/or examples as described herein are therefore to be considered as illustrative and not restrictive.

The invention claimed is:

1. A device to assist a patient on a bed to transfer between a lying position and a seated position, the device comprising:

an arm hold, the arm hold comprising a panel configured to be clinched by the patient between the forearms and the chest of the patient;

a roll shaft connected to the arm hold, the roll shaft configured to:

translate vertically under power to transport the arm Bold between a lower first position and a higher second position; and rotate under power to roll the arm hold such that the panel is aligned substantially horizontally while the arm hold is in the lower first position, and aligned substantially vertically while the arm hold is in the higher second position, whereby the patient clinching the arm hold to his or her chest is transferred between a lying position when the arm hold is in the lower first position and a seated position when the arm hold is in the higher second position.

2. The device according to claim 1, wherein the arm hold further comprises a hand grip configured to be gripped in the hands of the patient.

3. The device according to claim 1, wherein the device is configured to enable the position and/or motion of the arm hold to be customised for use with beds and patients of varying dimensions.

4. The device according to claim 1, wherein the arm hold is configured to retract, and thereby provide clearance and sufficient space to enable the patient and others to move around the bed, when not in use.

5. The device according to claim 1, further comprising a leg support configured to transfer the legs of the patient between a lying position and a seated position.

6. The device according to claim 5, wherein the leg support comprises a panel incorporating recesses configured to generally conform to the legs of the patient.

7. The device according to claim 5, wherein the leg support is configured to rotate the lower legs of the patient about a horizontal axis between a lying position, in which the lower legs are substantially horizontal, and a seated position, in which the lower legs are substantially vertical.

8. The device according to claim 5, wherein the device is configured to allow the position and/or motion of the leg support to be customisable for use with beds and patients of varying dimensions.

9. The device according to claim 5, wherein the leg support is configured to retract, and thereby provide sufficient clearance space to enable the patient and others to move around the bed, when not in use.

10. The device according to claim 5, wherein the leg support is configured to slide between the lower legs of the patient and the bed to position the leg support when activated to transfer the patient from a lying position to a seated position.

11. The device according to claim 5, wherein the arm hold and the leg support are configured to pivot the patient about his or her buttocks such that the patient will, when in a seated position, face a side of the bed.

12. The device according to claim 11, wherein the device is configured to be adjustable to allow for selection of which side of the bed the patient will face when in the seated position.

13. The device according to claim 1, wherein the device is configured to be controlled by the patient, thereby allowing the patient to transfer between a lying position and a seated position without assistance from a human caregiver.

14. The device according to claim 1, wherein the device comprises a back up power source to operate the device in case of an electricity outage.

15. The device according to claim 1, wherein the device comprises a stabilizer which extends under or around a bed to stabilize the device against toppling over when transferring a patient between a lying position and a seated position.

16. The device according to claim 1, wherein the device comprises a pull up hold that a patient may hold to stabilize him or herself when transferring between a seated position and a standing position.

17. A method of using the device according to claim 1, wherein a patient clinches the arm hold to his or her chest and is transferred between the lying position and the seated position.

18. The method according to claim 17, wherein the position and/or motion of the arm hold is customisable for use with beds and patients of varying dimensions, and the position and/or motion of a leg support is calibrated to suit the physical dimensions of the bed and the patient.

19. The method according to claim 17, wherein the arm hold is retractable, and the arm hold retracts when not in use to enable the patient to move around the bed.

20. The method according to claim 17, wherein the device comprises a leg support, and wherein the leg support transfers the legs of the patient between a lying position and a seated position.

21. The method according to claim 20, wherein the position and/or motion of the leg support is customisable, and the position and/or motion of the leg support is calibrated to suit the physical dimensions of the bed and the patient.

22. The method according to claim 20, wherein the leg support is retractable from the bed, and the leg support retracts when not in use to enable the patient to move around the bed.

23. The method according to claim 20, wherein the leg support is configured to slide between the lower legs of the patient and the bed, wherein the leg support slides when between the bed and the lower legs of the patient to position the leg support below the lower legs of the patient and transfer the patient from a lying position to a seated position.

24. The method according to claim 17, wherein the device is controllable by the patient, and the patient activates the device to transfer between a lying position and a seated position.

25. A method of transferring a patient between a lying position and a seated position, the method comprising:

positioning an arm hold in front of the patient's chest;

positioning a leg rest underneath the patient below his or her buttocks;

moving the arm hold and the leg rest concurrently to pivot the patient about his or her buttocks; and raising the arm hold vertically while the patient clinches the arm hold to his or her chest to raise the patient's torso.

26. The method of claim 25, wherein the step of moving the arm hold and the leg rest concurrently to pivot the patient about his or her buttocks and the step of raising the arm hold vertically while the patient clinches the arm hold to his or her chest to raise the patient's torso are performed simultaneously.

* * * * *